US010697074B2

(12) United States Patent
Renaudier et al.

(10) Patent No.: US 10,697,074 B2
(45) Date of Patent: Jun. 30, 2020

(54) ELECTROLYTIC CELL INTENDED FOR THE PRODUCTION OF ALUMINIUM AND ELECTROLYTIC SMELTER COMPRISING THIS CELL

(71) Applicant: Rio Tinto Alcan International Limited, Montreal (CA)

(72) Inventors: Steeve Renaudier, Saint Michel de Maurienne (FR); Benoit Bardet, Villargondran (FR); Yves Rochet, Saint Jean de Maurienne (FR); Denis Laroche, Jonquiere (CA); Olivier Martin, Hermillon (FR)

(73) Assignee: Rio Tinto Alcan International Limited, Montreal (CA)

( * ) Notice: Subject to any disclaimer, the term of this patent is extended or adjusted under 35 U.S.C. 154(b) by 273 days.

(21) Appl. No.: 14/911,164

(22) PCT Filed: Jul. 30, 2014

(86) PCT No.: PCT/CA2014/050721
§ 371 (c)(1),
(2) Date: Feb. 9, 2016

(87) PCT Pub. No.: WO2015/017923
PCT Pub. Date: Feb. 12, 2015

(65) Prior Publication Data

US 2016/0186344 A1 Jun. 30, 2016

(30) Foreign Application Priority Data

Aug. 9, 2013 (FR) ..... 13 01910
Jan. 27, 2014 (FR) ..... 14 00170

(51) Int. Cl.
*C25C 7/00* (2006.01)
*C25C 3/10* (2006.01)
*C25C 3/16* (2006.01)

(52) U.S. Cl.
CPC ..... *C25C 7/007* (2013.01); *C25C 3/10* (2013.01); *C25C 3/16* (2013.01)

(58) Field of Classification Search
CPC ..... C25C 7/007; C25C 3/06–24
See application file for complete search history.

(56) References Cited

U.S. PATENT DOCUMENTS 3,575,827 A 4/1971 Johnson
3,607,685 A 9/1971 Johnson
(Continued)

FOREIGN PATENT DOCUMENTS

GB 783419 A 9/1957
WO 2012021924 A1 2/2012

OTHER PUBLICATIONS

Oct. 2, 2014—International Search Report of PCT/CA2014/050721.

(Continued)

*Primary Examiner* — Ciel P Thomas
(74) *Attorney, Agent, or Firm* — Banner & Witcoff, Ltd.

(57) ABSTRACT

This cell (1) comprises a pot shell (2) having two longitudinal sides (18) which are symmetrical in relation to a longitudinal median plane (P) of the electrolytic cell (1), an anode assembly which can only move in vertical translation with respect to the pot shell (2), the anode assembly comprising an anode block (100) and a transverse anode support (200) extending at right angles to the longitudinal sides (18) of the pot shell (2), from which support the anode block (100) is suspended. The anode support (200) comprises two connecting portions (202) from which electrolysis current is (Continued)

Figure 1:
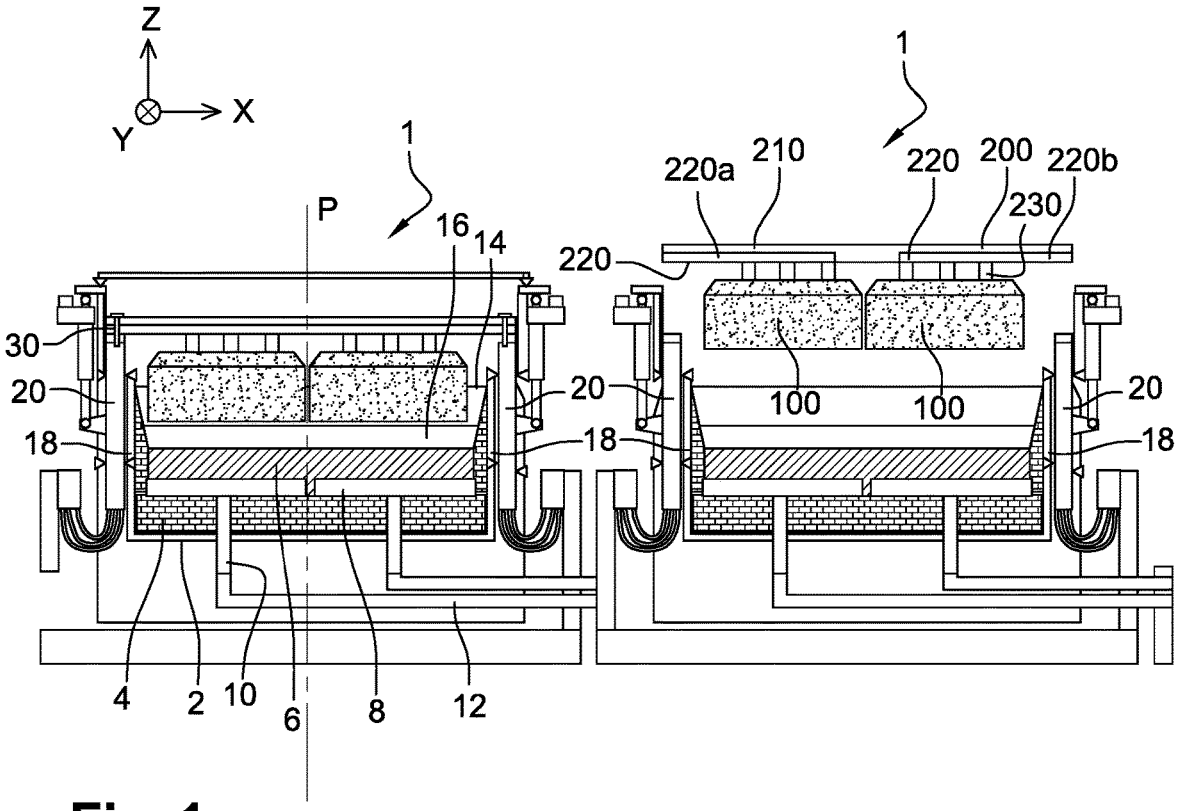

supplied to the anode support (200), and the cell (1) comprises electrical connection conductors (20) electrically connected to the two connecting portions (202) of the anode support (200), the two connecting portions (202) being located on either side of the plane (P).

30 Claims, 4 Drawing Sheets

(56) References Cited

U.S. PATENT DOCUMENTS

| | | | | |
|---|---|---|---|---|
| 4,326,939 | A * | 4/1982 | Schmidt-Hatting | C25C 3/16 204/230.5 |
| 4,720,333 | A * | 1/1988 | Duval | C25C 3/10 204/241 |
| 5,378,338 | A | 1/1995 | Langon et al. | |
| 9,255,338 | B2 * | 2/2016 | Prado | C25C 7/00 |
| 2008/0078674 | A1 * | 4/2008 | Platonov | C25C 3/16 204/279 |

OTHER PUBLICATIONS

May 4, 2017—(EP) Supplemental Search Report—App 14834525.
Oct. 31, 2019—(BR) Office Action—App BR112016001951-2 (Partial Eng Trans).

* cited by examiner

ELECTROLYTIC CELL INTENDED FOR THE PRODUCTION OF ALUMINIUM AND ELECTROLYTIC SMELTER COMPRISING THIS CELL

CROSS-REFERENCE TO RELATED APPLICATIONS

The present application is a U.S. National Phase filing of International Application No. PCT/CA2014/050721, filed on Jul. 30, 2014, designating the United States of America and claiming priority to French Patent Application No. 13/01910 filed Aug. 9, 2013, and French Patent Application No. 14/00170 filed Jan. 27, 2014, and the present application claims priority to and the benefit of all the above-identified applications, which are incorporated by reference herein in their entireties.

This invention relates to an electrolytic cell designed for the production of aluminum and an electrolysis plant, in particular an aluminum smelter, including this electrolytic cell.

It is known that aluminum can be produced industrially from alumina by electrolysis using the Hall-Héroult process. For this purpose an electrolytic cell is used, conventionally comprising a steel pot shell within which there is a lining of refractory materials, a cathode of carbon material, through which pass cathode conductors intended to collect the electrolysis current at the cathode to route it to the cathode collector bars passing through the bottom or the sides of the pot shell, linking conductors extending substantially horizontally to the next cell from the cathode collector bars, an electrolyte bath in which the alumina is dissolved, at least one anode assembly comprising a substantially vertical anode rod and at least one anode block suspended from the anode rod and immersed in the electrolyte bath, an anode frame in which the anode assembly is suspended through the substantially vertical anode rod, this being able to move in relation to the pot shell and the cathode with the anode frame and risers for the electrolysis current running upwards, connected to the linking conductors from the preceding electrolysis cell, to route the electrolysis current from the cathode collector bars to the anode frame and the anode assembly and anode of the next cell. The anodes are more particularly of the pre-baked anode type with pre-baked carbon blocks, i.e.i.e. baked before they are placed in the electrolytic cell.

As the anode blocks are consumed in the course of the electrolysis reaction the anode assemblies have to be periodically replaced. Conventionally, anode assemblies are replaced on one side of the electrolytic cell.

However the replacement of anode assemblies on the sides of the cells makes it necessary to have a relatively large space between the cells.

Document U.S. Pat. No. 3,575,827 discloses the replacement of an anode assembly from the top of a cell. According to this document the electrolytic cells are arranged transversely in relation to the length of the row which they form. The electrolytic cells comprise an anode assembly with an anode conductor in the form of an electrically conducting non-vertical but horizontal plate, on which there is suspended an anode, the conducting plate being provided with electrolysis current by flexible electrical conductors connected to a single upstream side of the anode assembly The anode assembly can therefore be taken out through the top of the cell.

However, because of this horizontal arrangement and with the shape of the plate the anode conductor is more exposed to high temperatures. This results in an increase in electrical resistivity, involving energy losses, and a reduction in the mechanical integrity of the anode assembly.

Furthermore, the use of a plate that is connected and fed with current only on the upstream side to distribute current to the anodes in the cell implies substantial electrical balancing between the upstream side and the downstream side of the cell, given the width of present-day cells. So to ensure correct electrical balancing a plate of very large cross-section must be used, or the plate must be subdivided into a plurality of separate parallel plates forming a plurality of separate electrical circuits having equivalent resistance. In both cases this would result in anode assemblies equipped with anode electrical conductors which are very bulky and costly in raw materials.

In addition to this, the heat flow extracted by the anode conductors from the upstream side of the cell would result in significant thermal imbalance between the two sides of the cell, making it difficult to control the electrolysis process and substantially reducing the service life of the cell.

This invention is therefore designed to remedy these disadvantages either wholly or in part by providing an electrolytic cell in which the anode assembly can be replaced from the top, while continuing to offer high performance.

For this purpose this invention relates to an electrolytic cell intended for the production of aluminum by electrolysis, in which the electrolytic cell comprises a pot shell having two opposite longitudinal sides, an anode assembly which can move only in vertical translation with respect to the pot shell, the anode assembly comprising at least one anode block and a transverse anode support extending substantially transversely to the longitudinal sides of the pot shell, on which is suspended at least one anode block, the transverse anode support comprising two connecting portions from which the transverse anode support is to be supplied with electrolysis current, the electrolytic cell further comprising connecting electrical conductors electrically connected to the two connecting portions of the transverse anode support, characterized in that the two connecting portions are distant from each other in a substantially transverse direction of the electrolysis cell.

Because of this double connection on either side of the anode support it is possible to reduce the quantity of material comprising the latter and reduce its dimensions, particularly its average cross-section, while retaining balanced electrical conductivity over the width of the cell. The thermal equilibrium of the cell is furthermore not disturbed by major differences in heat losses between the upstream side and the downstream side because of this double connection on either side of the anode support, and more particularly on either side of the cell.

The electrolytic cell according to the invention therefore advantageously makes it possible to lighten the anode assembly and minimize its dimensions while making a saving in raw materials on the anode assembly, but also on peripheral structural equipment. The lightening and compactness of the anode assembly makes it possible to envisage the use of means of smaller dimensions, which are therefore less costly, for moving anode assemblies.

Lightening of the anode assembly also in practice makes it possible to more easily envisage replacement of the anode assembly from the top, that is to say i.e. by vertical upwards traction of the anode assembly. Replacement of the anode assembly via the top advantageously makes it possible to free up space between the cells, either to aid operations, or to bring the cells closer to each other, so that the cells are better aligned in the same space or the same number of cells are aligned in a smaller space.

Advantageously, the two opposite longitudinal sides are substantially symmetrical in relation to a longitudinal median plane of the electrolytic cell, and the two connecting portions are located on either side of that plane. More particularly the transverse anode support comprises two end portions and the connecting portions are located on these end portions.

According to a preferred embodiment the anode assembly comprises a first structure of a first electrical conducting material and a second structure of a second electrical conducting material, the second material having an electrical conductivity which is substantially higher than that of the first material.

This anode support therefore offers a combination of a material having high electrical conductivity, to provide electrical conductivity and reduce energy losses, and a material having an electrical conductivity which is certainly less but acts as a strong rigid load-bearing structure, making it possible to mechanically support a plurality of anode blocks, despite the fact that this load-bearing structure is exposed to high temperatures which may reach approximately 1,000° C.

The use of such a composite anode support makes it possible to reduce the quantity and cost of the raw materials required for the anode support to be able to perform the two functions of carrying electrical current and supporting the anode blocks.

The first material is more particularly steel, because of its low cost and high mechanical strength, including at high temperature. The second material is more particularly copper, because of its very high electrical conductivity, but also because of its ability to become deformed and its useful properties as a contact surface for an electrical connection.

An anode support of copper alone would deform under the weight of the anode blocks, more particularly because of the high temperatures in the cell. Furthermore an anode support of steel alone would have very large dimensions to ensure correct conduction of the electrolysis current to the anode blocks, despite the abovementioned improvements made through this invention.

Preferably the second structure is fixed to the first structure in such a way that the first structure mechanically supports the second structure. This attachment may be achieved for example by bolting, welding or molding one of the materials within the skeleton formed by the other material, in particular by molding copper within a steel skeleton.

According to a particular embodiment, the first structure comprises a transverse bar extending substantially transversely from one connecting portion to the other connecting portion.

Such a bar is less sensitive to the radiant heat given off by the electrolyte bath and a plate of equivalent cross-section located horizontally, and the surrounding air also circulates around it better. A bar is also mechanically more suitable for supporting heavy loads.

Advantageously, the bar extends between the connecting portions in a single piece.

"Extending in a single piece" is taken to mean that it extends from one connecting portion to the other without any discontinuity. In other words each longitudinal bar is of one piece and corresponds to a single mechanical piece extending from one connecting portion to the other.

The mechanical integrity of the bar is therefore improved and this may also limit energy losses in comparison with an electrolytic cell in which the bars forming the anode support are discontinuous, formed of a plurality of lengths joined to each other.

Advantageously, the connecting portions are located at the ends of the longitudinal bar and are more particularly located close to the longitudinal sides of the pot shell.

Advantageously, the second structure at least partly forms the connecting portions for the anode support.

Electrical connection of the anode assembly with the connecting electrolysis conductors of the cell is therefore made using the second structure formed of a material having good electrical conductivity. Voltage drops are therefore minimized, and the electrolysis current is carried to the anode blocks.

According to an advantageous embodiment, the second structure comprises two separate parts, each at least partly forming one of the two connecting portions.

It is not necessary that the second structure of better electrical conductivity should be continuous from one connecting portion to the other of the anode support because this second structure is used to supply electricity to the anode blocks, and as a consequence an electrical current does not pass through it over its entire length because it is provided with electrical current at two separate points which are at a distance from each other in a substantially transverse direction of the cell, in particular at the two opposite ends of the anode support on each side of the cell. This discontinuity, or separation of the second structure into two separate parts, makes it possible to minimize the quantity of the second material used, this second material conventionally being of high cost.

These two separate parts are more particularly distant from each other in the transverse direction of the cell.

Advantageously, the two opposite longitudinal sides of the cell are substantially symmetrical in relation to a longitudinal median plane of the electrolytic cell, and the two separate parts are located on either side of the plane (P). The electrolysis current flowing through each of the two separate parts then has a strength which is substantially identical, but in an opposite direction, in the anode support, so that electrical balancing in the support is achieved at the center of the anode support. Also, the two separate parts are advantageously substantially symmetrical in relation to the said plane. The anode assemblies may therefore be symmetrical in relation to a median plane in such a way that the anode assemblies can be inserted into the cell without it being necessary to comply with any predetermined orientation.

According to one preferred embodiment, the transverse anode support comprises a plurality of stubs attached to the first structure designed to be sealed in voids formed in the surface of the said at least one anode block, and the distance between the two separate parts in the transverse direction is substantially equivalent to the distance between two adjacent stubs.

When the anode blocks are supplied powered by means of stubs electrically connected to the anode support, a zone in which the current does not flow within the anode support may be produced between two stubs in such a way that this configuration provides a significant saving in the second material forming the second structure.

According to a preferred embodiment, the transverse anode support comprises a plurality of stubs attached to the first structure and each part is attached to the first structure only where the stubs are attached to a connecting portion. This attachment of the second structure to the first structure may for example be made by welding or bolting.

As a consequence, each stub may be fully powered electrically by the part of the second structure extending from the corresponding connecting portion to the attachment of the end of the stub to the first structure, which is the load-bearing structure. This way of attaching the second structure to the first structure also enables the first structure to be able to expand independently of the second structure in such a way that the temperature changes experienced by the anode support during its life do not damage it. More particularly, taking steel to be the first material and copper to be the second material, the first material will expand less than the second material when exposed to heat, and the second material, which is more flexible than the first material, which needs to be rigid to form the load-bearing structure, may deform slightly along the first structure between two points of attachment.

According to a particular embodiment, the anode assembly comprises two adjacent anode blocks in a transverse direction of the electrolytic cell, the two anode blocks being supported by the same first structure and arranged beneath two separate parts of the second structure.

Present-day electrolytic cells are very wide, so it is advantageous to use two anode blocks over the width of the cell, and therefore attached to the same anode assembly to aid removal of the gas accumulating beneath the anode blocks, and manufacture and handling of the anode blocks.

According to a preferred embodiment, the anode support forms a ring bounded by two transverse bars connected to each other at their ends, the bars extending substantially parallel to each other and perpendicular to the longitudinal sides of the pot shell.

The annular shape of the anode support makes it possible to achieve savings in raw material and lightening in comparison with an anode support formed of a single bar or a plate, which would cover the same overall surface area in a horizontal plane, as the ring formed in this way, for equivalent mechanical strength and electrical conductivity.

This annular shape in particular makes it possible to minimize the overall lengths of the electrical conductors from the connecting portions to the anode blocks.

The annular shape makes it possible to minimize warping or deformation of the hollowed-out anode supports, due to successive expansions undergone by the anode supports.

The annular or parallel multiple bar shape also offers the possibility of widening the anode assemblies while minimizing the cost of materials. The fact that wide anode assemblies are available, particularly with two adjacent anode blocks in the longitudinal direction of the electrolytic cell, makes it possible to reduce the number of means for moving the structure for lifting the anode assemblies in a vertical direction, in particular to reduce the number of jacks, and the number of electrical connections to the connecting electrolysis conductors.

The anode assembly therefore advantageously comprises two adjacent anode blocks in a longitudinal direction of the electrolytic cell, each anode block being supported by a separate transverse bar. No bar extends over the space between the two adjacent anode blocks in the longitudinal direction of the cell, so that the heat radiated by the bath between these anode blocks does not affect the resistance and the conductivity of the anode supports. The bars do not constitute therefore form any obstacle to the overspill of covering material between these adjacent anode blocks.

The stubs connecting the anode support to the anode blocks advantageously extend substantially vertically beneath each bar.

This therefore offers a saving in materials in comparison with stubs having multi-directional cross-members and longitudinal members supporting a plurality of feet sealed into an anode block.

According to a preferred embodiment, the first structure forms a ring and the second structure is located within the ring formed by the first structure.

This advantageously makes it possible to achieve savings in materials because the length and quantity of the material for the second structure is thereby minimized in order to fulfil the electrical conduction function, more particularly from the connecting portions to the upper attachment ends of the stubs on the first structure. The stubs must above all be secured mechanically, and it is for this reason that they have to be attached, more particularly welded, to the first structure. Electrical connection to the second structure may then be made via the side of the stub, or the current may pass through the first structure, but for a short distance, so as not to have an adverse effect on energy consumption. In this way, when the stubs connecting the anode support to the anode blocks advantageously extend substantially vertically beneath each bar, the first structure is located vertically above the stubs, while the second structure is offset towards the interior of the ring in relation to the axis along which the stubs extend; the second structure does not lie within the continuity of this axis but its length is minimized because it is positioned inside the ring Also the second material forming the second structure is protected by the first structure surrounding it against any deterioration due to strong thermal radiation caused by shrinkage of the anode assembly adjacent to the electrolytic bath, splayed corrosive materials and any impacts during handling of the anode support alone, or anode assemblies comprising such an anode support.

Advantageously, the ring has U-shaped ends, the second structure has two parts each having a U-shape corresponding to and matching that of the ends of the ring and at ambient temperature the length of the outer perimeter wall of the curved portions of the U formed by each part of the second structure (220) is shorter than the length of the inner perimeter wall of the curved portions of the U formed by the corresponding end of the ring.

This therefore prevents premature wear of the anode support caused by the expansion of the second structure through the effect of temperature in the electrolytic bath during operation. Without such an arrangement the second material would be forced against the first structure. As the second material has a tendency to expand more than the first material the manner of construction defined above allows the second material to expand without being forced against the first material, risking damaging the second material or the attachments of the second structure to the first structure. A zone of free expansion is preserved for expansion of the second structure, via a radius of curvature which is shorter than the second structure, to avoid breakage of the attachments (welds/bolts) and the electrolysis connections between the first structure and the second structure.

Advantageously, the anode assembly comprises a plurality of stubs extending between the anode support and the said at least one anode block, and in that the anode support comprises a portion forming an elbow in a vertical plane at each of its ends in such a way that the connecting portions for the anode support are located above the top surface of the stubs.

In this way, the distance between the anode support and the anode block, and therefore the height of the stubs, can be reduced. Excessively high stubs would result in an increase in the potential drop, which harms the performance of the electrolytic cell, as well as an increase in the length and mass of the conducting material forming the anode support.

Advantageously, the anode support comprises a plurality of stubs extending substantially vertically between the anode support and the said at least one anode block, and in that the stub has a substantially horizontal sealing end which is sealed within the anode block.

The use of such stubs makes it possible to reduce the total number of stubs and improve the thermal and electrical equilibrium of the anode assemblies.

According to one advantageous possibility the anode support comprises at least one longitudinal reinforcing member extending in a substantially transverse direction of the electrolytic cell and connecting the two ends of the anode support.

This feature makes it possible to reinforce the anode support mechanically and limit its flexion or deformation.

According to an advantageous form of construction the anode support comprises a cross-member extending in a longitudinal direction of the electrolytic cell and connecting the two longitudinal bars together and, if appropriate, connecting them with the said at least one reinforcing longitudinal member.

This further reinforces the anode support in order to limit flexion.

Longitudinal and transverse members may act as means for gripping the anode assemblies for handling purposes.

According to one embodiment, the anode assembly comprises two adjacent anode blocks in a longitudinal direction of the electrolytic cell, each anode block being supported by a separate longitudinal bar.

According to another aspect, the invention relates to an electrolysis plant, in particular an aluminum smelter, comprising an electrolytic cell having the aforesaid characteristics in which the electrolytic cells are located transversely in relation to the length of the row.

Figure 2:
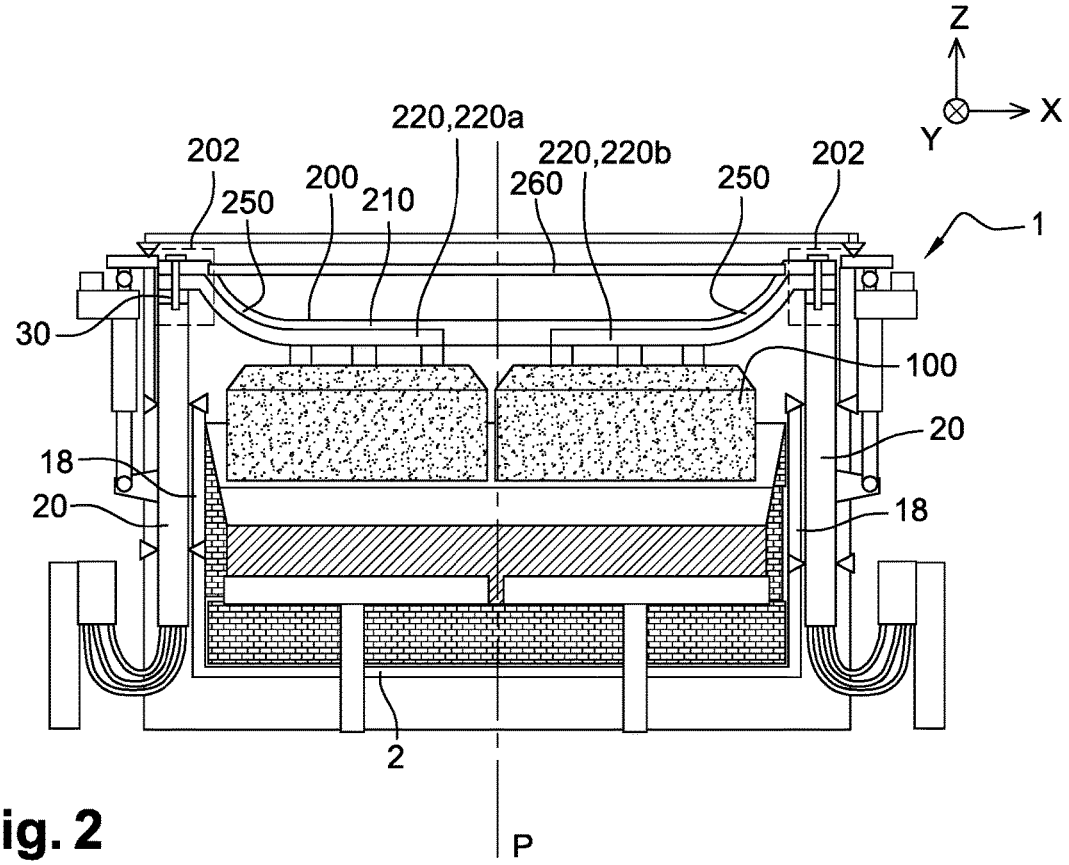
Figure 3:
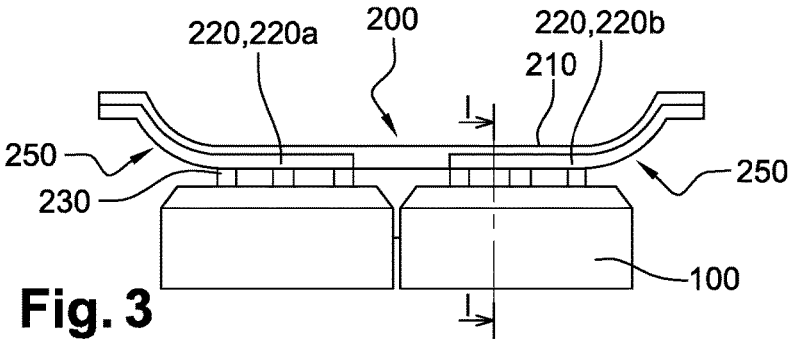
Figure 5:
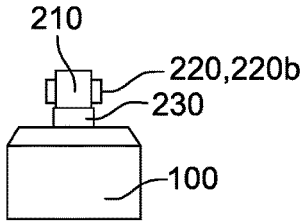
Figure 4:
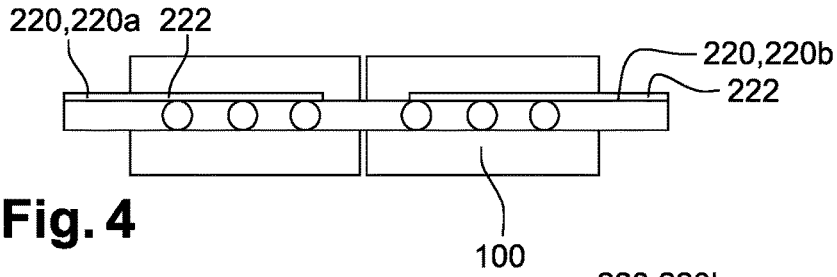
Figure 6:
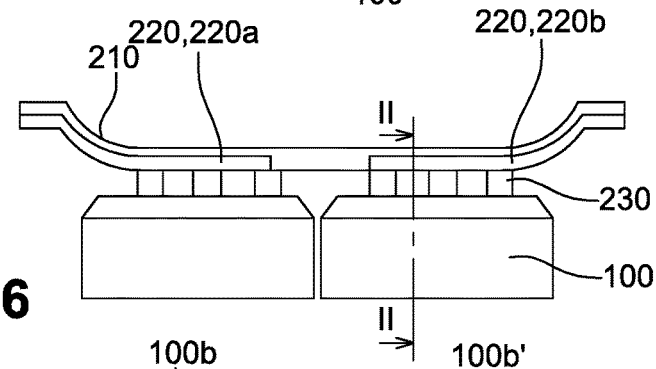
Figure 8:
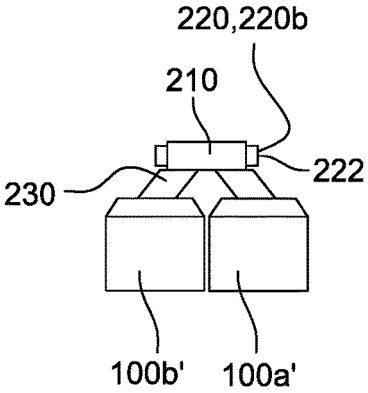
Figure 7:
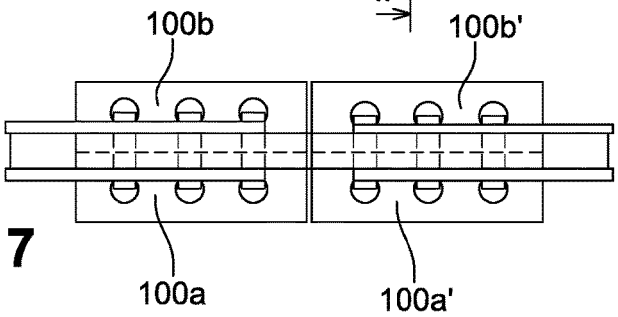
Figure 9:
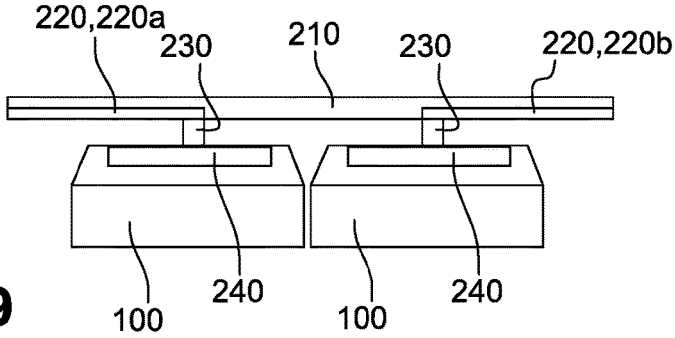
Figure 11:
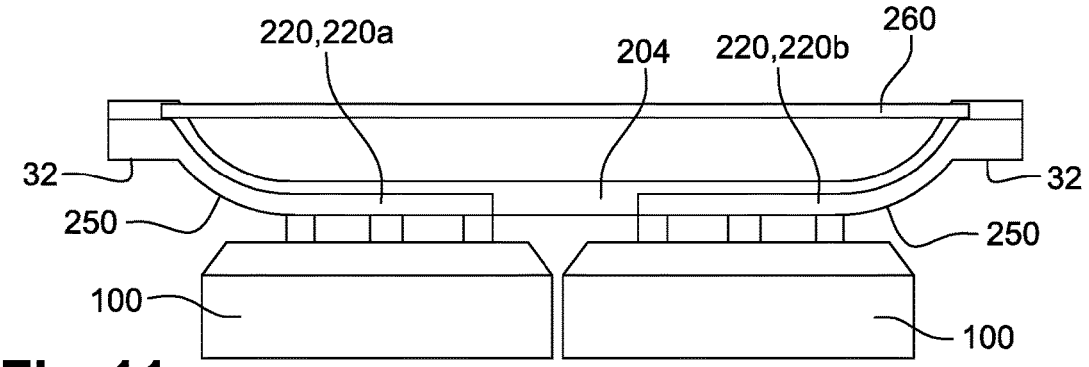
Figure 10:
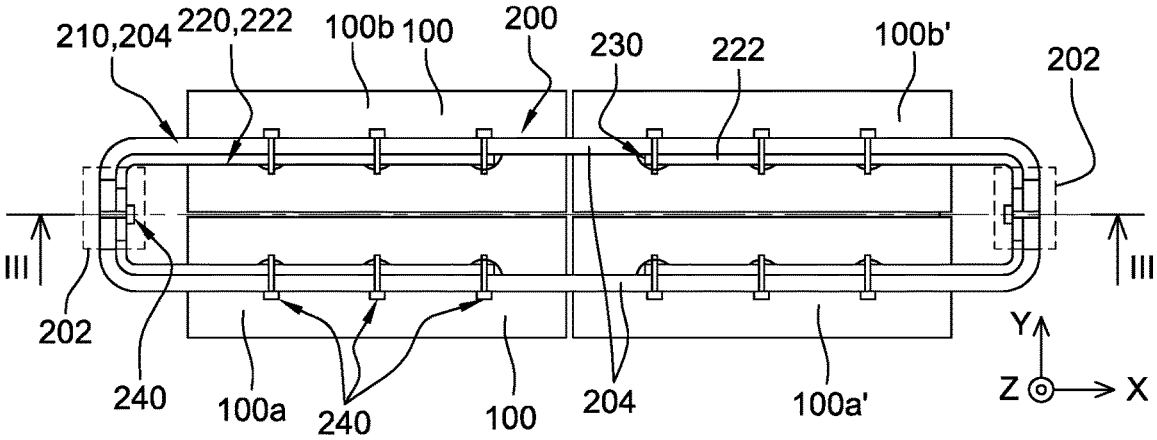
Figure 13:
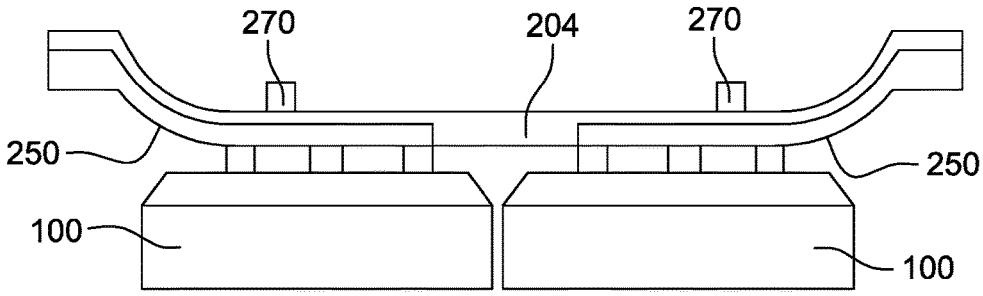
Figure 12:
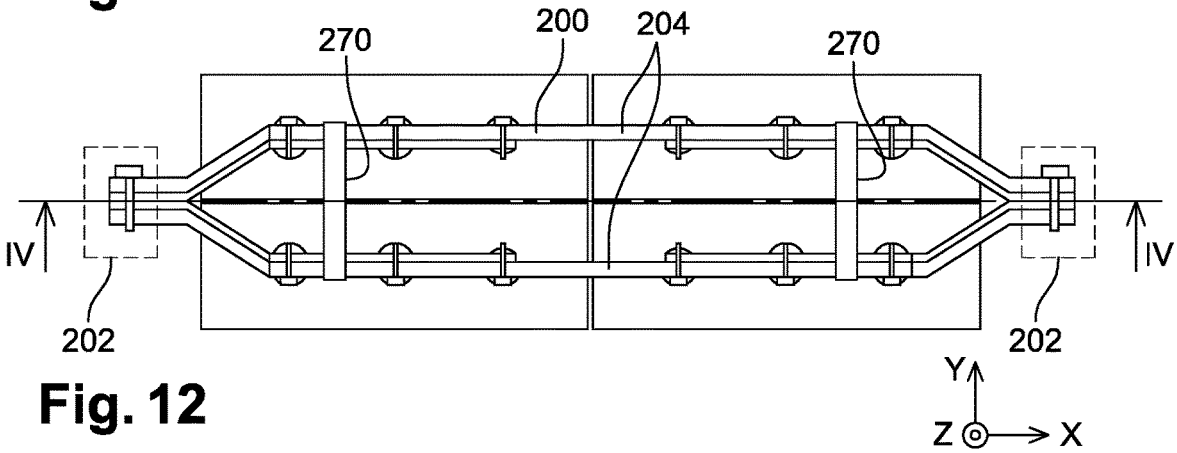
Figure 14:
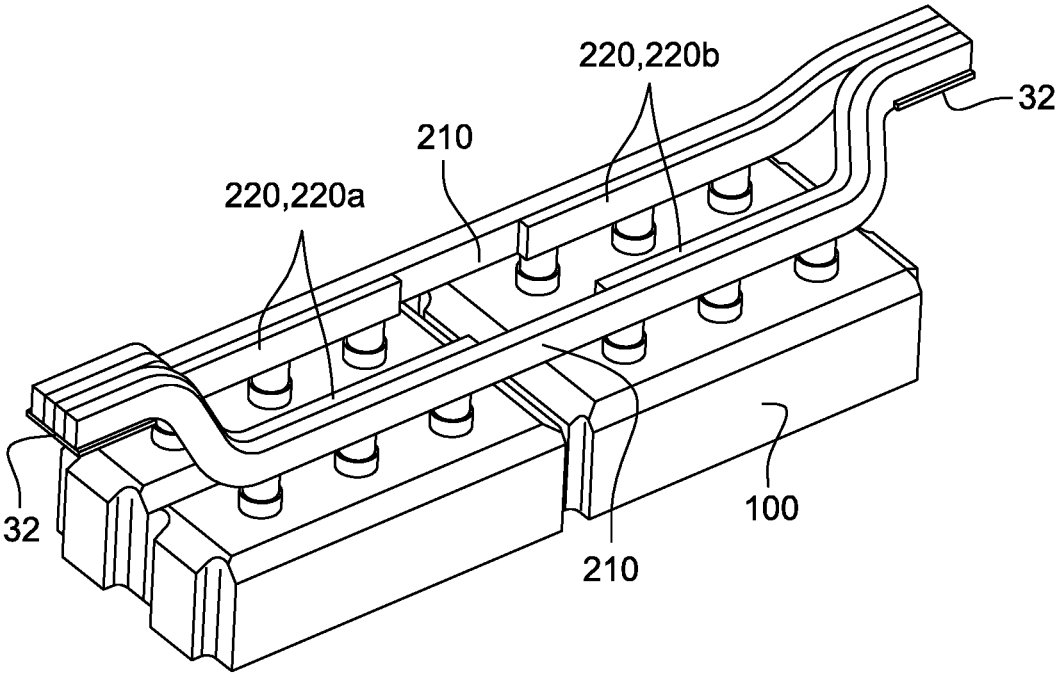
Figure 15:
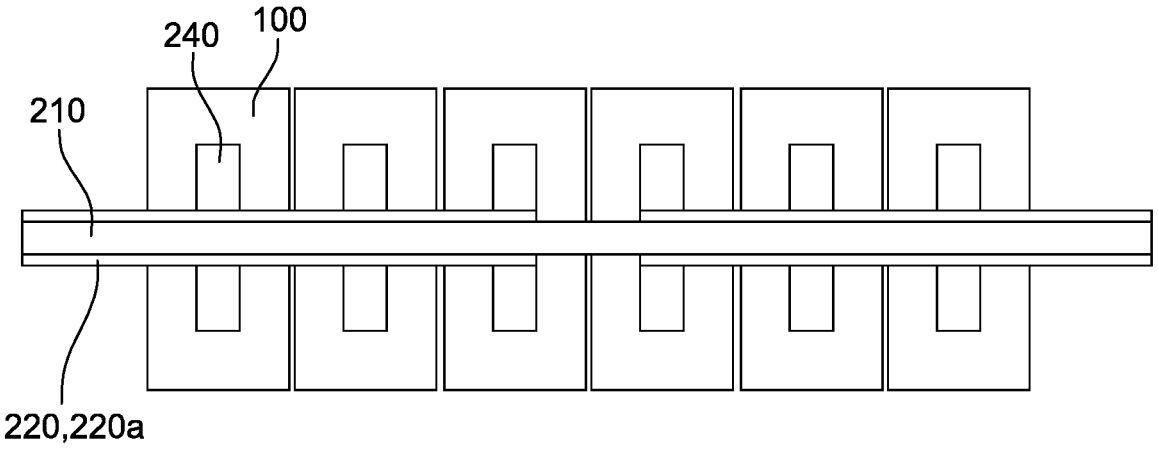

Other features and advantages of this invention will be clearly apparent from the following detailed description of an embodiment provided by way of a non-limiting example with reference to the appended drawings, in which:

FIG. 1 is a schematic view from the side in cross-section of an electrolytic cell according to one embodiment of the invention, FIG. 2 is a schematic view from the side in cross-section of an electrolytic cell according to one embodiment of the invention, FIG. 3 is a schematic view from the side of an anode assembly of an electrolytic cell according to one embodiment of the invention, FIG. 4 is a view of the anode assembly in FIG. 3 from above, FIG. 5 is a view in cross-section along the line I-I in FIG. 3 of the side respectively on which an anode assembly is illustrated, FIG. 6 is a schematic view from the side of an anode assembly of an electrolytic cell according to one embodiment of the invention, FIG. 7 is a view of the anode assembly in FIG. 6 from above, FIG. 8 is a view in cross-section along the line II-II in Figure FIG. 6, FIG. 9 is a side view in schematic cross-section of an anode assembly of an electrolytic cell according to one embodiment of the invention, FIG. 10 is a schematic view from above of an anode assembly of an electrolytic cell according to one embodiment of the invention, FIG. 11 is a schematic side view in cross-section along the line III-Ill in FIG. 10, FIG. 12 is a schematic view from above of an anode assembly of an electrolytic cell according to one embodiment of the invention, FIG. 13 is a schematic side view in cross-section along the line IV-IV in FIG. 12, FIG. 14 is a schematic perspective view of an anode assembly in FIGS. 12 and 13, FIG. 15 is a schematic view from above of an anode assembly of an electrolytic cell according to one embodiment of the invention, FIG. 1 shows electrolytic cells 1 according to one embodiment of the invention which are intended for the production of aluminum by electrolysis.

Electrolytic cells 1 comprise a pot shell 2, made in particular of steel, within which there is a lining 4 of refractory materials, a cathode 6 of carbon material, through which pass cathode conductors 8 designed to collect the electrolysis current at cathode 6 to route it to cathode collector bars 10, passing through the base or sides of pot shell 2, linking conductors 12 running substantially horizontally as far as the next electrolytic cell 1 from cathode collector bars 10, an electrolyte bath 14, in which alumina is dissolved, and a layer 16 of liquid metal, in particular liquid aluminum, which forms during the electrolysis reaction.

Pot shell 2 may be of substantially parallelepiped shape. It comprises two opposite longitudinal sides 18, which are substantially symmetrical in relation to a longitudinal median plane P of electrolytic cell 1. Pot shell 2 may have two transverse sides connecting the longitudinal sides substantially bounding a rectangle.

By longitudinal median plane is meant the plane substantially perpendicular to a transverse direction X of electrolytic cell 1 separating electrolytic cell 1 into two substantially equal parts.

It will be noted that electrolytic cell 1 is arranged transversely in relation to the length of a row of electrolytic cells. In other words electrolytic cell 1 extends lengthwise in a longitudinal direction Y which is substantially perpendicular to the X direction in which the row of electrolytic cells, which electrolytic cell 1 belongs to, extends.

Electrolytic cell 1 according to the invention also comprises an anode assembly. The anode assembly comprises one or more anode blocks 100 and a transverse anode support 200 extending transversely in relation to the length of electrolytic cell 1, from which anode block or blocks 100 is/are suspended.

Anode blocks 100 are more particularly made of carbon material of the pre-baked type, i.e. baked before being placed in electrolytic cell 1.

The anode assembly can only move in translation, in particular in vertical translation, in relation to pot shell 2. Electrolytic cell 1 is also configured to allow an anode assembly to be changed via the top, as illustrated in FIG. 1 for cell 1 located to the right of FIG. 1.

As shown in FIG. 1 or 2, transverse anode support 200 extends substantially at right angles to the longitudinal sides 18 of pot shell 2. In other words transverse anode support 200 extends in a substantially transverse direction X of electrolytic cell 1.

Transverse anode support 200 comprises two connecting portions 202. Electrolysis current is provided to anode support 200 via these connecting portions 202.

Electrolytic cell 1 further comprises electrical connection conductors 20, electrically connected to two connecting portions 202, to carry electrolysis current to anode support 200.

Electrical connection conductors 20 extend substantially vertically along each longitudinal side 18 of pot shell 2.

It will be noted that the two connecting portions 202 are located on either side of plane P so that anode support 200 benefits from connection on both sides.

The two connecting portions 202 are separate and distant from each other in a substantially transverse direction X of electrolytic cell 1.

The two connecting portions 202 may be arranged substantially symmetrically in relation to plane P.

They may be arranged at each of the two ends of transverse anode support 200.

In particular, connecting portions 202 may be arranged close to longitudinal sides 18 of pot shell 2.

More specifically, they may be arranged substantially vertically above the longitudinal sides 18 of pot shell 2, or more advantageously they may not extend beyond pot shell 2, i.e. they may be arranged outside the volume obtained by the vertical translation of a surface projected onto a horizontal plane by pot shell 2.

Connecting portions 202 are therefore less exposed to the heat released by electrolytic bath 14 when in operation.

As shown in FIGS. 10 and 12, anode support 200 is in the form of a ring. In particular, it comprises two longitudinal bars 204, which are substantially parallel to each other, substantially at right angles to the longitudinal sides 18 of pot shell 2, i.e. in a substantially transverse direction X of the electrolytic cell. Bars 204 are connected to each other at their ends.

Each longitudinal bar 204 extends in one piece between its two ends. In other words, each longitudinal bar 204 comprises a single mechanical piece extending from one of its ends to its other end.

Connecting portions 202 are advantageously located at the ends of each of longitudinal bars 204, and therefore at the ends of the ring formed by anode support 200, in such a way that they are as far removed as possible from the center of electrolytic cell 1.

As shown in the figures, anode support 200 may comprise a first structure 210 designed to ensure the mechanical integrity of anode support 200 and a second structure 220 intended to carry electrolysis current from connecting portions 202 to anode block or blocks 100.

First structure 210 is made of a first electrically conducting material. Second structure 220 is made of a second electrically conducting material. The second material has a substantially greater electrical conductivity than that of the first material.

For example, first structure 210 is made of steel and second structure 220 is made of copper. So the first material may be steel and the second material may be copper, anode support 200 thereby comprising a steel/copper composite.

First structure 210 is formed by longitudinal bars 204. Second structure 220 may be formed by additional copper bars, separate from longitudinal bars 204. The copper bars may match the shape of longitudinal bars 204.

Second structure 220 is attached to first structure 210. Therefore first structure 210 supports second structure 220.

First structure 210 is of an annular shape. For this purpose, longitudinal bars 204 may be a single bar bent at its ends, or separate bars attached together at their ends. Copper conducting bars 222 forming second structure 220 may also be bent to match the shape of first structure 210.

Connecting electrical conductors 20 may be connected to second structure 220. As shown in FIG. 14, second structure 220 more particularly forms a plate 32 in each connecting portion 202, the plate being designed to rest against a connection surface of associated electrical connection conductor 20. A connector 30 may be used to provide a good electrical connection for anode support 200 by compressing connecting portion 202 (the plate) against the associated electrical connection conductor 20 (the connecting surface).

Second structure 220 is advantageously subdivided into two separate parts 220*a*, 220*b* corresponding to two separate conduction bars 222 at a distance from each other. Part of each of conducting bars 222 at least partly forms one of two connecting portions 202.

According to the embodiment in FIGS. 1 to 9, second structure 220 is located on one side of bar 204 forming first structure 210.

According to the embodiment in FIGS. 10 to 13, second structure 220 is located within the ring formed by first structure 210. The second structure is therefore shorter than it would be if located on the exterior of the ring and is also protected by the first part surrounding it.

More particularly, according to the embodiment in FIGS. 10 and 11, the ring formed by first structure 210 has U-shaped ends and the two conducting bars 222 or parts 220*a*, 220*b* of second structure 220 are also U-shaped, matching that of the ends of the ring formed by first structure 210. Furthermore, at ambient temperature, i.e. at a temperature of between 15° C. and 25° C., the length of the outer perimeter wall of the curved portions of the U formed by each conducting bar 222 is shorter than the length of the inner perimeter wall of the curved portions of the U formed by the corresponding end of the ring.

When cold there is also a gap between conducting bars 222 and longitudinal bars 204, in particular at the curved portions of these bars.

As shown in the figures, the anode assembly comprises a plurality of stubs 230 between anode support 200 and anode block or blocks 100.

Each stub 230 comprises a proximal end attached to an upper face of anode block, or one of anode blocks 100, and a distal end attached to first structure 210 only. The proximal end may for example be welded to first structure 210. An electrical connection may further be made by welding between stubs 230 and second structure 220.

Each stub 230 may extend in a substantially straight direction between its proximal end and its distal end, as shown in FIG. 5.

Second structure 220 is advantageously attached to first structure 210 only at connecting portions 202 and/or at the distal ends of stubs 230, as illustrated in FIGS. 10 and 12.

Second structure 220 is for example riveted, bolted or welded to the first structure. According to the embodiment in FIGS. 10 and 12, a plurality of attachment members 240 keeps second structure 220 attached to first structure 210.

Each part 220*a*, 220*b* provides separate stubs 230 with electrical current, and the parts are distant from each other in a substantially transverse direction of the electrolytic cell.

Because of this double connection on either side of the anode support it is possible to use a second discontinuous structure of two parts 220*a*, 220*b* and minimize the costs of raw material. The two parts 220*a*, 220*b* are more particularly separated by a distance corresponding to the distance between the two stubs 230 closest to the center of the anode assembly and are symmetrical in relation to plane P.

Each stub 230 may comprise a single proximal end and a single distal end. In other words stubs 230 may have no cross-members or longitudinal members extending in a substantially horizontal plane.

As shown in FIG. 9, the proximal end may be of one piece, with a substantially horizontal bar 240 or sealing plate extending transversely in relation to the cell and sealed within anode block 100.

FIG. 15 shows another anode assembly in which such a bar 240 or sealing plate extends longitudinally in relation to the cell.

As shown in FIGS. 2 to 8 and 10 to 13, anode support 200 advantageously comprises an elbowed portion 250 at each of its ends.

More specifically, longitudinal bars 204 and, if applicable, conducting bars 222 may be bent in order to have an elbow portion 250 in a vertical plane at each of their ends so that the connecting portions of the anode support are located above the top surface of the stubs.

The distance between the anode support and the anode block may therefore be smaller, and as a consequence so also may be the height of the stubs. Excessively high stubs would result in an increase in the potential drop, which harms the performance of the electrolytic cell, as well as an increase in the length and mass of the conducting material forming the anode support.

As shown in FIGS. 2 and 11, anode support 200 may comprise at least one longitudinal reinforcing member 260 extending in a substantially transverse direction X of electrolytic cell 1 connecting the two ends of anode support 200.

As shown in FIG. 12, anode support 200 may further include one or more cross-members 270, extending in a substantially longitudinal direction Y of electrolytic cell 1. Cross-member or members 270 connect the two longitudinal bars 204 together.

These longitudinal members 260 and cross-members 270 may also serve as means of attachment for handling the anode assembly or the anode support.

According to the embodiment in FIGS. 10 to 14 the anode assembly comprises two adjacent anode blocks 100*a*, 100*b* in a longitudinal direction Y of electrolytic cell 1. Each anode block 100*a*, 100*b* is advantageously supported by a separate longitudinal bar 204.

As will be seen in the figures, the proximal end of each stub 230 may be located on a median line of the upper surface of corresponding anode block 100.

Each stub 230 may for example extend in only a substantially vertical direction.

According to the embodiment in FIGS. 6 to 8, the anode assembly comprises two adjacent anode blocks 100*a*, 100*a*' or 100*b*, 100*b*' in a longitudinal direction Y of electrolytic cell 1, and these two anode blocks 100*a*, 100*a*' or 100*b*, 100*b*' are borne by the same longitudinal bar 204.

As shown in FIG. 8, stubs 230 may then extend obliquely or at least have a horizontal component.

Still according to the embodiment in FIGS. 6 to 8, stubs 230 connecting one longitudinal bar 204 to two anode blocks 100*a*, 100*b* or 100*a*', 100*b*' may be arranged in pairs. The two stubs 230 in one pair are aligned in a substantially longitudinal direction Y of the electrolytic cell 1. In other words the two stubs 230 in one pair may extend in a plane which is substantially perpendicular to a substantially transverse direction X of electrolytic cell 1.

According to another aspect, the invention relates to an electrolysis plant, in particular and aluminum smelter, comprising an electrolytic cell 1 as described previously.

Of course the invention is not in any way limited to the embodiment described above, this embodiment only being provided by way of example. Modifications are possible, in particular from the point of view of the constitution of the various components, or through replacement by technical equivalents, without thereby going beyond the scope of protection of the invention.

The invention claimed is:

1. An electrolytic cell configured for the production of aluminum by electrolysis, in which the electrolytic cell comprises a pot shell having two opposite longitudinal sides, an anode assembly configured to only move in vertical translation with respect to the pot shell and designed to be removed and replaced periodically, the anode assembly comprising at least one anode block and a transverse anode support extending substantially transversely to the longitudinal sides of the pot shell from which the at least one anode block is suspended, the transverse anode support comprising two connecting portions through which the transverse anode support is provided with electrolysis current, the electrolytic cell further comprising electrical connection conductors that are not configured to be removed and replaced periodically with the anode assembly, the electrical connection conductors being electrically connected to the two connecting portions of the transverse anode support, characterized in that the two connecting portions are at a distance from each other in a substantially transverse direction of the electrolytic cell, wherein the anode assembly is removably connected to the electrolytic cell such that the two connecting portions of the transverse anode support are removably connected to the electrical connection conductors, and wherein the anode assembly is supported by the electrical connection conductors and moveable with the electrical connection conductors.

2. The electrolytic cell according to claim 1, characterized in that the two opposite longitudinal sides are substantially symmetrical in relation to a longitudinal median plane of the electrolytic cell and characterized in that the two connecting portions are located on either side of the longitudinal median plane.

3. The electrolytic cell according to claim 2, characterized in that the transverse anode support comprises two end portions, and characterized in that the connecting portions are located on the end portions of the transverse anode support.

4. The electrolytic cell according to claim 1, characterized in that the transverse anode support comprises a first structure made of a first electrically conducting material and a second structure made of a second electrically conducting material, the second material having an electrical conductivity which is substantially greater than an electrical conductivity of the first material.

5. The electrolytic cell according to claim 4, characterized in that the first structure comprises a transverse bar extending substantially transversely from one connecting portion to the other connecting portion.

6. The electrolytic cell according to claim 5, characterized in that the transverse bar extends between the end portions in a single piece.

7. The electrolytic cell according to claim 4, characterized in that the second structure is attached to the first structure in such a way that the first structure mechanically supports the second structure.

8. The electrolytic cell according to claim 4, characterized in that the second structure at least partly forms the connecting portions of the anode support.

9. The electrolytic cell according to claim 4, characterized in that the second structure comprises two separate parts each at least partly forming one of the two connecting portions.

10. The electrolytic cell according to claim 9, characterized in that the two separate parts are distant from each other in the substantially transverse direction of the cell.

11. The electrolytic cell according to claim 10, characterized in that the two opposite longitudinal sides are substantially symmetrical in relation to a longitudinal median plane of the electrolytic cell, and in that the two separate parts are located on either side of the longitudinal median plane.

12. The electrolytic cell according to claim 11, characterized in that the two separate parts are substantially symmetrical in relation to the longitudinal median plane.

13. The electrolytic cell according to claim 10, characterized in that the transverse anode support comprises a plurality of stubs attached to the first structure designed to be sealed in voids formed in a surface of said at least one anode block, and characterized in that a distance between the two separate parts in the substantially transverse direction is equivalent to a distance between two adjacent stubs of the plurality of stubs.

14. The electrolytic cell according to claim 10, characterized in that the transverse anode support comprises a plurality of stubs attached to the first structure and that each of the two separate parts is attached to the first structure only at a location where the stubs and one of the connecting portions are attached.

15. The electrolytic cell according to claim 9, characterized in that the anode assembly comprises two adjacent anode blocks in the substantially transverse direction of the electrolytic cell, the two anode blocks being supported by the same first structure and located beneath the two separate parts of the second structure.

16. The electrolytic cell according to claim 4, characterized in that the first structure forms a ring, and in that the second structure is located within the ring formed by the first structure.

17. The electrolytic cell according to claim 16, characterized in that the ring has U-shaped ends, the second structure comprising two parts, each having a corresponding U-shape matching the U-shape of the ends of the ring, and characterized in that at ambient temperature a length of an outer perimeter wall of curved portions of the corresponding U-shape formed by each part of the second structure is shorter than a length of an inner perimeter wall in curved portions of the U-shape formed by the end of the ring matching the corresponding U-shape.

18. The electrolytic cell according to claim 1, characterized in that the anode support forms a ring bounded by two transverse bars connected together at ends thereof, the transverse bars extending substantially parallel to each other and perpendicular to the longitudinal sides of the pot shell.

19. The electrolytic cell according to claim 16, characterized in that the anode assembly comprises two adjacent anode blocks in a longitudinal direction of the electrolytic cell, each anode block being supported by one separate transverse bar of the two transverse bars.

20. The electrolytic cell according to claim 1, characterized in that the anode assembly comprises a plurality of stubs extending between the anode support and the at least one anode block, and characterized in that the anode support comprises a portion which is elbowed in a vertical plane at each end of the portion in such a way that the connecting portions of the anode support are located above the top surface of the stubs.

21. The electrolytic cell according to claim 1, characterized in that the anode assembly comprises a plurality of stubs extending substantially vertically between the anode support and the at least one anode block, and in that the stub comprises a substantially horizontal sealing end sealed within the at least one anode block.

22. The electrolytic cell according to claim 1, characterized in that the longitudinal sides extend in a substantially longitudinal direction, and each of the at least one anode block has a length extending in the substantially transverse direction and a width extending in the substantially longitudinal direction, wherein the length of each of the at least one anode block is greater than the width, and wherein the transverse anode support extends along the length of each of the at least one anode block.

23. The electrolytic cell according to claim 1, characterized in that the electrical connection conductors comprise a first electrical connection conductor located along one of the longitudinal sides and a second electrical connection conductor located along an opposite one of the longitudinal sides.

24. The electrolytic cell according to claim 1, characterized in that the electrical connection conductors extend along each of the longitudinal sides of the pot shell.

25. The electrolytic cell according to claim 1, further comprising connectors removably connecting the two connecting portions of the transverse anode support to the electrical connection conductors.

26. The electrolytic cell according to claim 1, characterized in that the anode assembly is removably connected to the electrolytic cell such that the entire anode assembly, including the at least one anode block and the transverse anode support, is removable together as a single unit.

27. An electrolysis plant comprising a row of electrolytic cells according to claim 1, arranged electrically in series, characterized in that the electrolytic cells are located transversely in relation to a length of the row.

28. An electrolytic cell configured for the production of aluminum by electrolysis, in which the electrolytic cell comprises a pot shell having two opposite longitudinal sides, an anode assembly configured to only move in vertical translation with respect to the pot shell and designed to be removed and replaced periodically, the anode assembly comprising at least one anode block and a transverse anode support extending substantially transversely to the longitudinal sides of the pot shell from which the at least one anode block is suspended, the transverse anode support comprising two connecting portions through which the transverse anode support is provided with electrolysis current, the electrolytic cell further comprising electrical connection conductors that are not configured to be removed and replaced periodically with the anode assembly, the electrical connection conductors being electrically connected to the two connecting portions of the transverse anode support, characterized in that the two connecting portions are at a distance from each other in a substantially transverse direction of the electrolytic cell, wherein the anode assembly is removably connected to the electrolytic cell such that the two connecting portions of the transverse anode support are removably connected to the electrical connection conductors, and wherein the electrical connection conductors do not extend over any part of the anode assembly.

29. An electrolytic cell configured for the production of aluminum by electrolysis, in which the electrolytic cell comprises a pot shell having two opposite longitudinal sides, an anode assembly configured to only move in vertical translation with respect to the pot shell and designed to be removed and replaced periodically, the anode assembly comprising at least one anode block and a transverse anode support extending substantially transversely to the longitudinal sides of the pot shell from which the at least one anode block is suspended, the transverse anode support comprising two connecting portions through which the transverse anode support is provided with electrolysis current, the electrolytic cell further comprising electrical connection conductors that are not configured to be removed and replaced periodically with the anode assembly, the electrical connection conductors being electrically connected to the two connecting portions of the transverse anode support, characterized in that the two connecting portions are at a distance from each other in a substantially transverse direction of the electrolytic cell, wherein the anode assembly is removably connected to the electrolytic cell such that the two connecting portions of the transverse anode support are removably connected to the electrical connection conductors, and wherein the electrical connection conductors are arranged fully under the anode support of the anode assembly.

30. An electrolytic cell configured for the production of aluminum by electrolysis, in which the electrolytic cell comprises a pot shell having two opposite longitudinal sides, an anode assembly configured to only move in vertical translation with respect to the pot shell and designed to be removed and replaced periodically, the anode assembly comprising at least one anode block and a transverse anode support extending substantially transversely to the longitudinal sides of the pot shell from which the at least one anode block is suspended, the transverse anode support comprising two connecting portions through which the transverse anode support is provided with electrolysis current, the electrolytic cell further comprising electrical connection conductors that are not configured to be removed and replaced periodically with the anode assembly, the electrical connection conductors being electrically connected to the two connecting portions of the transverse anode support, characterized in that the two connecting portions are at a distance from each other in a substantially transverse direction of the electrolytic cell, wherein the anode assembly is removably connected to the electrolytic cell such that the two connecting portions of the transverse anode support are removably connected to the electrical connection conductors, and wherein the electrical connection conductors connect directly to a bottom surface of the transverse anode support.

* * * * *